US005372525A

United States Patent [19]

Wu et al.

[11] Patent Number: 5,372,525

[45] Date of Patent: Dec. 13, 1994

[54] CONNECTOR FOR FASTENER FOR CHRISTMAS LIGHT STRINGS

[76] Inventors: Jeng-Shyong Wu, 4 Fl. No. 5, Hsing Shyur Road, Hsin-Chu City,, Taiwan, Prov. of China; Jeou N. Tseng, No. 504, Chung-Hua Road, Sec. 4, Hsin-Chu City, Taiwan, Prov. of China

[21] Appl. No.: 895,918

[22] Filed: Jun. 9, 1992

[51] Int. Cl.[5] ..... H01R 9/03

[52] U.S. Cl. ..... 439/656; 439/699; 439/930

[58] Field of Search ..... 439/459, 656, 699, 930; 313/318

[56] References Cited

U.S. PATENT DOCUMENTS 4,579,413 4/1986 Weidler ..... 439/656 X
5,035,643 7/1991 Forish et al. ..... 439/699 X
5,094,632 3/1992 Chen et al. ..... 439/699

*Primary Examiner*—Khiem Nguyen
*Attorney, Agent, or Firm*—Wood, Phillips, VanSanten, Hoffman & Ertel

[57] ABSTRACT

A connector and fastener are used particularly for a Christmas light string. The connector has a wire holding portion and a socket-engaging portion. Locking keys are formed on the wire holding portion and receiving holes are formed on the receiving portion for engagement with said locking keys when said wire holding portion is inserted into said socket-engaging portion. The fastener has at least one snapping element disposed on a socket of another Christmas light string and a corresponding number of flat tongues formed on the outer periphery of said connector for snap fitting when said connector is engaged with said socket. The connector may be configured to connect two wires respectively to two Christmas light strings or may be a connector with a socket to be inserted with another connector or an electrical gadget.

9 Claims, 11 Drawing Sheets

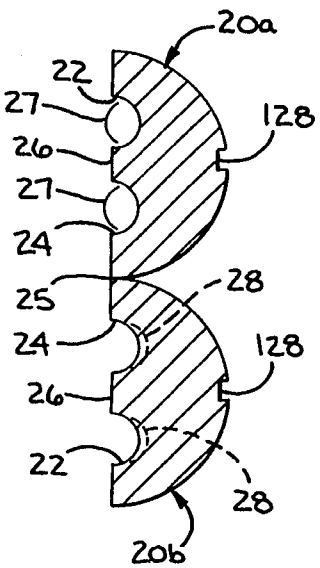
FIG. 2
FIG. 1
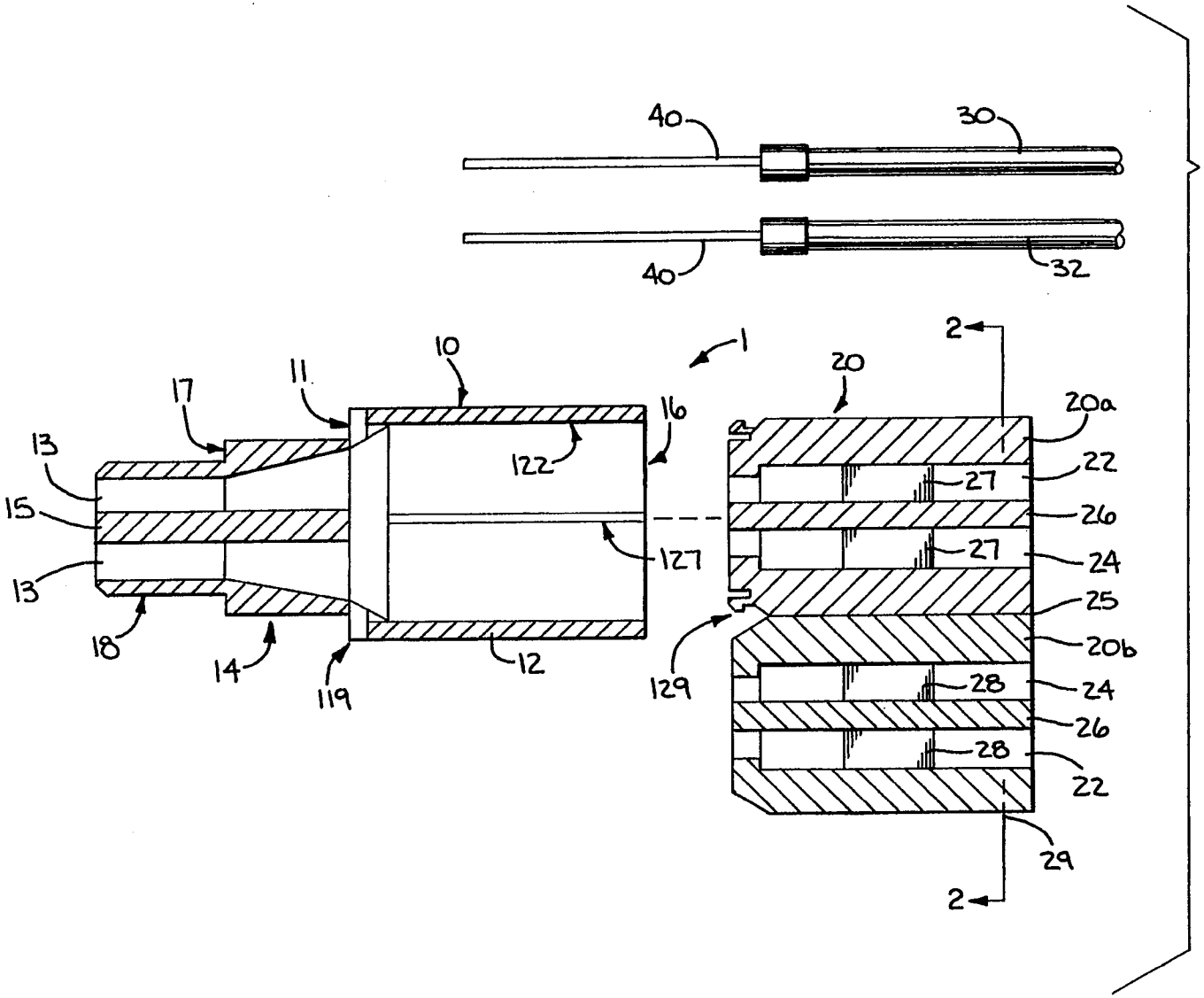

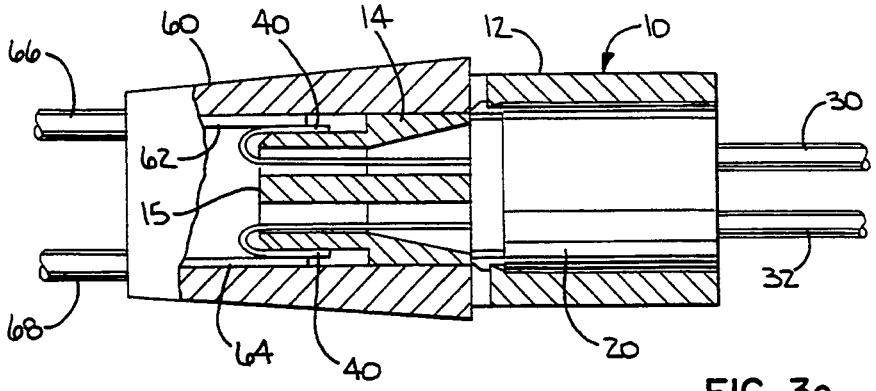
FIG. 3e
FIG. 4
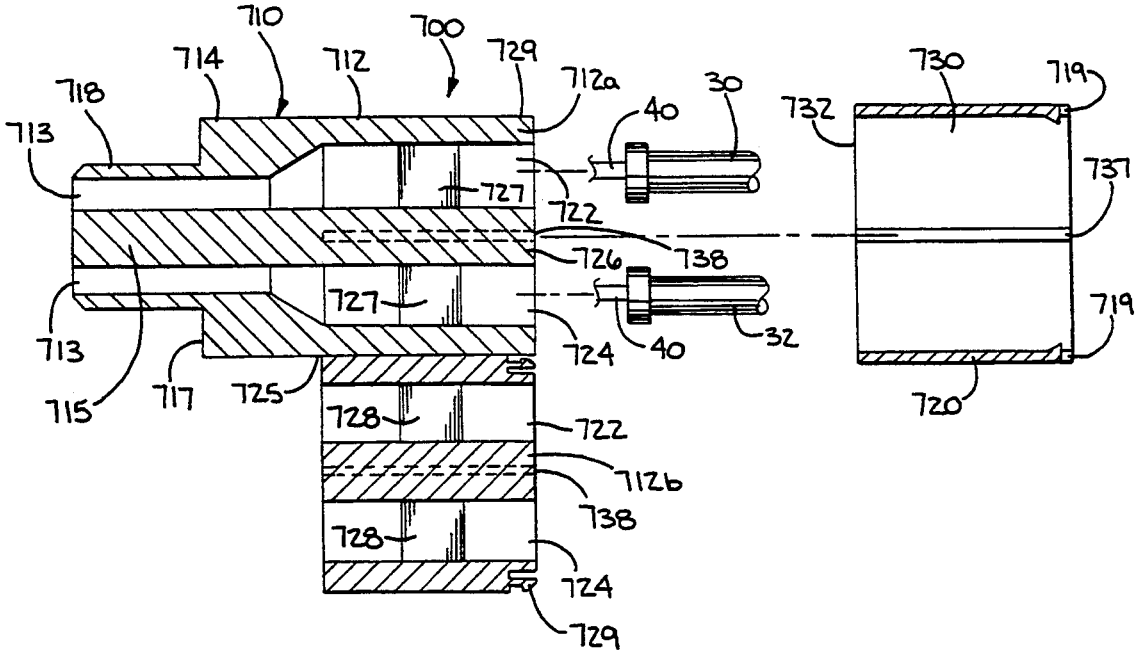

CONNECTOR FOR FASTENER FOR CHRISTMAS LIGHT STRINGS

BACKGROUND OF THE INVENTION

1. Field of the Invention

The present invention relates to a connector and fastener for Christmas light strings and more particularly to an improved connector and fastener which engages with any selected socket of another Christmas light string for attaching more light bulbs to the Christmas light string for decoration.

2. Background Art

The fastener for connectors and sockets of this invention used in Christmas light strings is similar to the socket and bulb snap fasteners for Christmas light strings disclosed in U.S. Pat. Nos. 4,943,899 and 4,970,632.

U.S. patent application Ser. No. 675,310 of Wu et al. (Wu is also one of the inventors of the present invention) discloses a connector for Christmas light strings and fasteners therefor.

In this prior art, in FIG. 17, the connector 1 comprises a wire holding portion 20 for receiving and holding wires 30, 32 therein and a socket-engaging portion 10 for engaging with a conventional socket 60 of a Christmas light string (not shown).

The socket-engaging portion 10 includes an annular hollow receiving portion 12, a first annular protrusion 14, and a second annular protrusion 18. The annular hollow receiving portion 12 has a compartment 122 therein and an opening 16 at one end thereof and a wire holding portion 20, which includes two half casings 20*a* and 20*b*, each having two slots 22 and 24 separated by a wall 26 formed therebetween. The two half casings 20*a* and 20*b* are made of insulating material and one edge 25 thereof is formed together such that the two half casings 20*a* and 20*b* are pivotable with respect to each other.

Additionally, an annular recess 29 is formed on an outer periphery of the wire holding portion 20, and an annular flange 19 is formed on an inner periphery of the receiving portion 12 of the socket-engaging portion 10, such that when the wire holding portion 20 is inserted into the compartment 122 of the receiving portion 12, the annular recess 29 engages with the annular flange 19 to securely retain the wire holding portion 20 in the socket-engaging portion 10.

FIG. 18 shows another prior art socket and fastener. A T-shaped tongue 230 of insulating material, having a shoulder 232, is formed in the vicinity of an upper margin of the connector 1. A V-shaped groove 234 is formed on a lower side of the T-shaped tongue 230 at an end opposite to the free end of the tongue 230 and extends transversely across the length of tongue 230. A flexible receiving means 220 of insulating material is formed relative to the T-shaped tongue 230 on an upper margin of a periphery of the socket 60. The receiving means 220 comprises two opposite, L-shaped protrusions 222 which together form a compartment 224 and a path 226 slightly narrower than the width of the T-shaped tongue 230.

When engaging the connector 1 and the socket 60, the T-shaped tongue 230 is first bent downward about the V-shaped groove 234, and then the T-shaped tongue 230 is snapped into the compartment 224 via the path 226 such that the shoulder 232 of the T-shaped tongue 230 abuts a lower surface of both protrusions 222, as shown in FIG. 18*a*.

But, this prior art has some drawbacks. The annular recess and corresponding annular protrusion structure is neither easy to be engaged for connection nor easy to disconnect when the connection has to be repeated again. There is also a problem that the T-shaped tongue may be broken at a V-shaped location in a bending operation.

SUMMARY OF THE INVENTION

In view of the foregoing drawbacks, therefore, the present invention provides a durable connector and fastener being very suitable for a Christmas light string for indoor or outdoor use.

The present invention intends to provide an improved connector with fastening means for Christmas light strings.

It is an object of the present invention to provide an improved connector for Christmas light strings.

It is another object of the present invention to provide favorable fastener structure for the connector and the socket, respectively, used in two Christmas light strings.

It is still another object of the present invention to provide a cost effective connector and a durable fastener for positively securing a socket and a connector, respectively, in two Christmas light strings.

These and additional objects if not set forth specifically herein, will be readily apparent to those skilled in the art from the detailed description provided hereunder with appropriate reference to the accompanying drawings.

BRIEF DESCRIPTION OF THE DRAWINGS

FIG. 1 is an exploded cross-sectional view of a connector in accordance with the present invention;

FIG. 2 is a cross-sectional view showing a wire receiving portion of the connector taken along line 2—2 of FIG. 1, according to the present invention;

FIGS. 3*a*, 3*b*, 3*c*, 3*d*, 3*e* show the assembly of the connector according to the present invention;

FIG. 4 n exploded cross-sectional view of another connector in accordance with the present invention;

DETAILED DESCRIPTION OF THE PREFERRED EMBODIMENTS

Figure 3A:
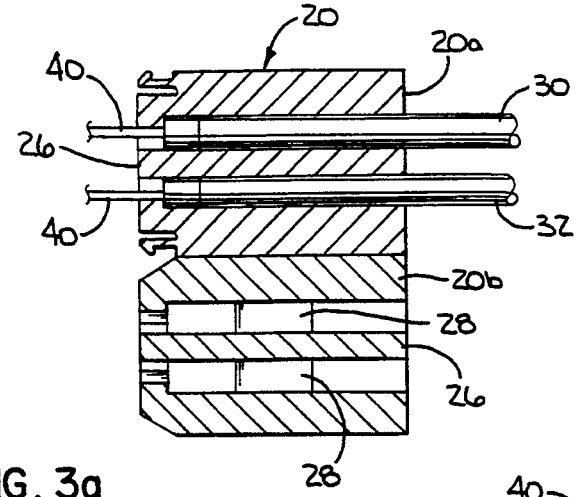

Referring to FIG. 1, the connector 1, according to the present invention for a second Christmas light string, comprises a wire holding portion 20 for receiving and holding wires 30, 32 therein and a socket-engaging portion 10 for engaging with a conventional socket 60 of a first Christmas light string (not shown).

The socket-engaging portion 10 includes an annular hollow receiving portion 12, a first annular protrusion 14, and a second annular protrusion 18. The annular hollow receiving portion 12 has a compartment 122 therein and an opening 16 at one end thereof. A first end of the first annular protrusion 14 protrudes from the other end of the receiving portion 12, thereby forming a first shoulder 11 thereat. A first end of the second annular protrusion 18 protrudes from a second end of the first annular protrusion 14 thereby forming a second shoulder 17 thereat. The receiving portion 12, the first annular protrusion 14, and the second protrusion 18 are integrally made of insulating material.

The first annular protrusion 14 has an outer diameter less than an inner diameter of the annular hollow receiving portion 12. The second annular protrusion 18 has an outer diameter less than the outer diameter of the first annular protrusion 14. Two guiding channels 13 extend longitudinally of the first and second annular protrusions 14 and 18 to communicate with the compartment 122 of the receiving portion 12 and are separated by a wall 15, also extending longitudinally of the first and second annular protrusions 14 and 18.

Also, referring to FIG. 1 and FIG. 2, the wire holding portion 20 includes two half casings 20*a* and 20*b*, each having two slots 22 and 24 separated by a wall 26 formed therebetween. The two half casings 20*a* and 20*b*, are made of insulating material and one edge 25 thereof is formed together such that the two half casings 20*a* and 20*b* are pivotable with respect to each other between a first position shown in FIG. 1 and a second position shown in FIG. 3*b*.

In order to retain the conducting wires 30 and 32 in the wire holding portion 20, a protrusion 27 is formed in slots 22 and 24 of the half casing 20*a*, and a corresponding recess 28 is formed in slots 22 and 24 of the other half casing 20*b*.

Additionally, at least one locking key, e.g., a hook head type 129, is formed on the front end of the outer periphery of the wire holding portion 20, and at least one receiving hole 119, with or without a protruding retainer, is formed on the first shoulder 11 and front end of the receiving portion 12 of the socket-engaging portion 10, such that when the holding portion 20 is inserted into the compartment 122 of the receiving portion 12, the locking keys 129 engage respectively with the receiving holes 119 to securely retain the wire holding portion 20 in the socket-engaging portion 10.

Further, at least one longitudinal straight line ridge 127 is formed on the inside surface of said compartment 122 of said socket-engaging portion 10, and at least one longitudinal straight line notch 128 is formed on the outside surface of said wire holding portion 20. The longitudinal straight line ridge fits said longitudinal straight line notch to guide said wire holding portion 20 into said socket-engaging portion 10 correctly and smoothly until the locking keys 129 are settled and retained in the receiving holes 119.

Figure 3B:
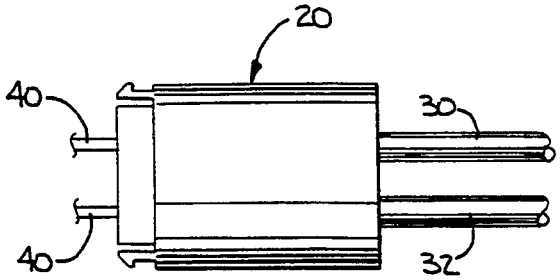
Figure 3C:
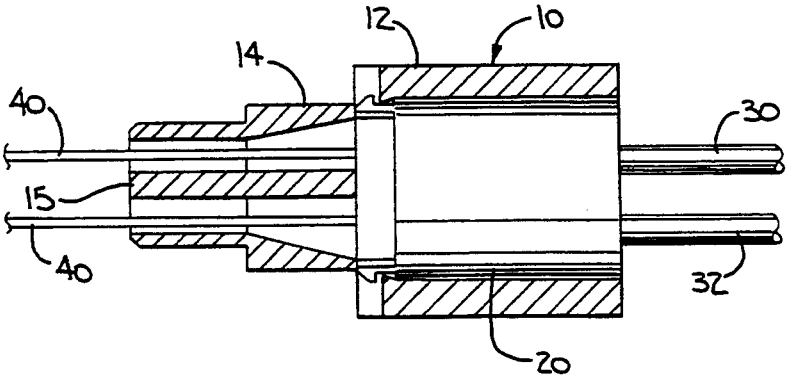
Figure 3D:
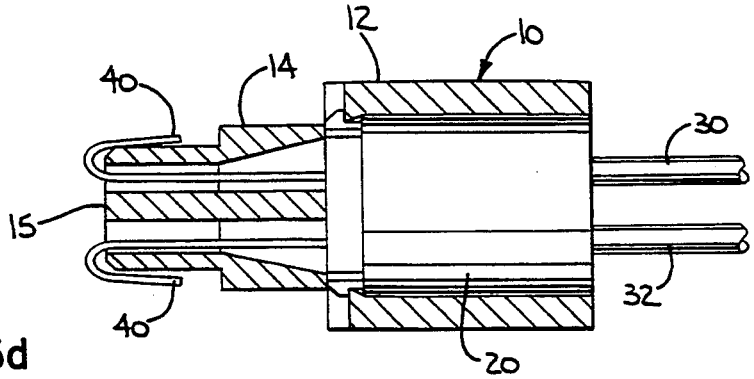

During assembly, two conducting wires 30 and 32, each with a contact blade 40, are respectively placed into the slots 22 and 24 of the two half casings 20*a* and 20*b* as shown in FIG. 3*a*. The two half casings 20*a* and 20*b* are then closed to a position as shown in FIG. 3*b*. Next, the wire holding portion 20 is directed into the compartment 122 of the receiving portion 12 of the socket-engaging portion 10 with the two contact blades 40 passing through respective guiding channels 13, as shown in FIG. 3*c*. The two contact blades 40 are bent back around the outside of the second annular protrusion 18, as shown in FIG. 3*d*, for engagement with two contacts 62 and 64 of the socket 60 of the first Christmas light string, wherein the contacts 62 and 64 are respectively electrically connected with wires 66 and 68 of the first Christmas light string. The first Christmas light string is conventional and thus no further explanation is required. FIG. 3*e* shows the engagement of the connecter 1 of the present invention and a conventional socket 60 of a conventional Christmas light string.

FIG. 4 shows another embodiment of the connector according to the present invention. In this embodiment the connector 700 comprises an outer casing 720 and a socket-engaging portion 710 for engaging with a conventional socket 60.

The socket-engaging portion 710 includes an annular wire holding portion 712, a first annular protrusion 714, and a second annular protrusion 718. A first end of the first annular protrusion 714, protrudes from one end of the wire holding portion 712 and a first end of the second annular protrusion 718 protrudes from a second end of the first annular protrusion 714, thereby forming a shoulder 717 thereat. The wire holding portion 712, the first annular protrusion 714, and the second protrusion 718 are integrally formed of insulating material.

The first annular protrusion 714 has an outer diameter the same as the outer diameter of the wire holding portion 712 and the second annular protrusion 718 has an outer diameter less than the outer diameter of the first annular protrusion 714.

The wire holding portion 712 includes two half casings 712*a* and 712*b*, each having two slots 722 and 724 separated by a wall 726 formed therebetween. One half casing 712*a* is integrally formed with the first annular protrusion 714 and the second annular protrusion 718. The other half casing 712*b* is formed integrally with the half casing 712*a* at one edge 725 thereof such that the two half casings 712*a* and 712*b* are pivotable with respect to each other as the two half casings 20*a* and 20*b* of the above-illustrated embodiment.

Two guiding channels 713 extend longitudinally of the first and second annular protrusions 714 and 718 to respectively communicate with the slots 722 and 724 of the half casing 712*a* and are separated by a wall 715, also extending longitudinally of the first and second annular protrusions 714 and 718. The annular, hollow, outer casing 720 has a compartment 730 therein and an opening 732 at one end thereof.

In order to retain the conducting wires 30 and 32 in the wire holding portion 712, a protrusion 728 is formed in slots 722 and 724 of the half casing 712*b*, and a corresponding recess 727 is formed in slots 722 and 724 of the other half casing 712*a*.

Additionally, at least one locking key, e.g. a hook head type 729, is formed on the rear end of the outer periphery of the wire holding portion 710, and at least one receiving hole 719, with or without a protruding retainer, is formed on the rear edge of the outer casing 720, such that when the wire holding portion 712 is inserted into the compartment 730 of the outer casing 720, the locking keys 729 engage respectively with the receiving holes 719 to securely retain the wire holding portion 710 in the outer casing 720.

Further, at least one longitudinal straight line ridge 737 is formed on the inside surface of said compartment 730 of said outer casing 720, and at least one longitudinal straight line notch 738 is formed on the outside surface of said socket-engaging portion 710. The longitudinal straight line ridge fits said longitudinal straight line notch to guide said socket-engaging portion 710 into said outer casing 720 correctly and smoothly until the locking keys 729 are settled and retained the receiving holes 719.

During assembly, two conducting wires 30 and 32, each with a contact blade 40, are respectively placed into the slots 722 and 724 of the two half casings 712*a* and 712*b* with the two contact blades 40 passing through respective guiding channels 713. The two contact blades 40 are bent back around the outside of the second annular protrusion 718. The two half casings 712*a* and 712*b* are then closed. The wire holding portions 712 are inserted into the compartment 730 of the outer casing 720 via the opening 732. Accordingly, the assembled connector 700 is ready for engagement with the socket 60.

Figure 5:
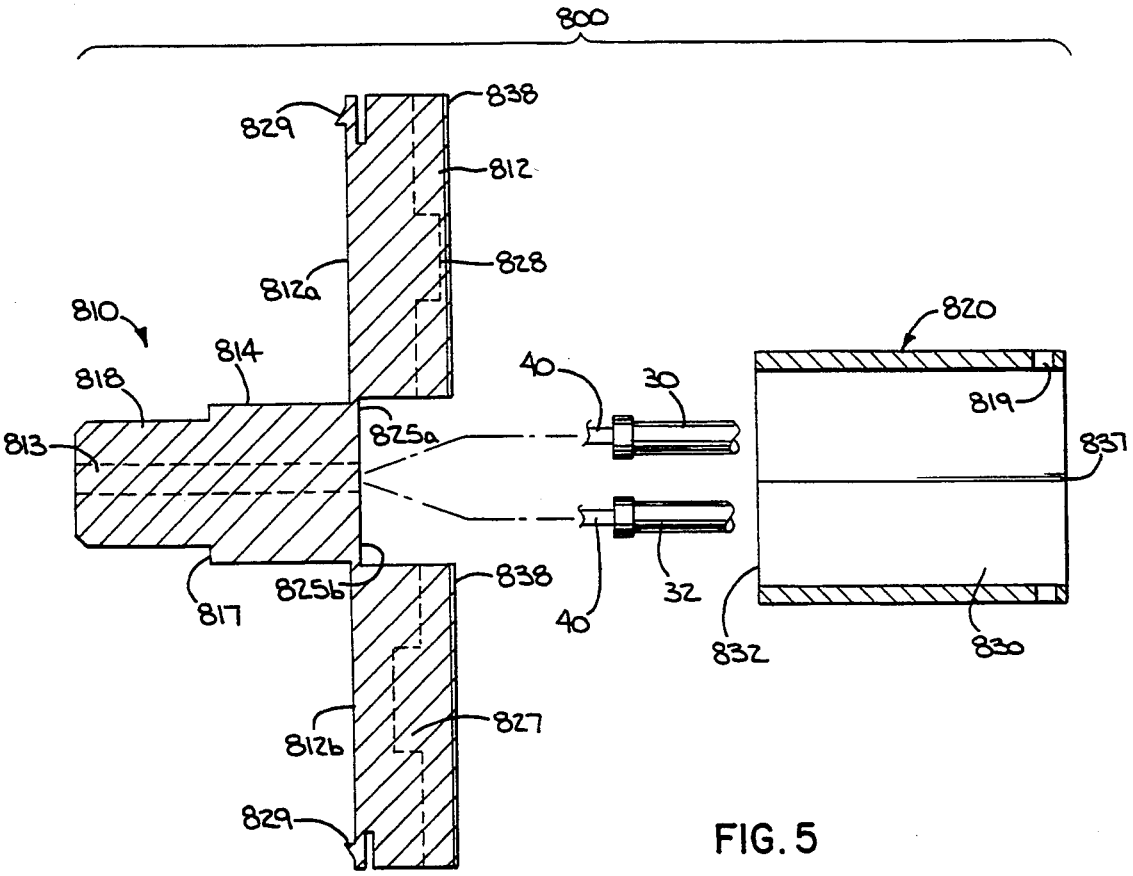
FIG. 5 exploded, cross-sectional view of yet another connector in accordance with the present invention.
Figure 6:
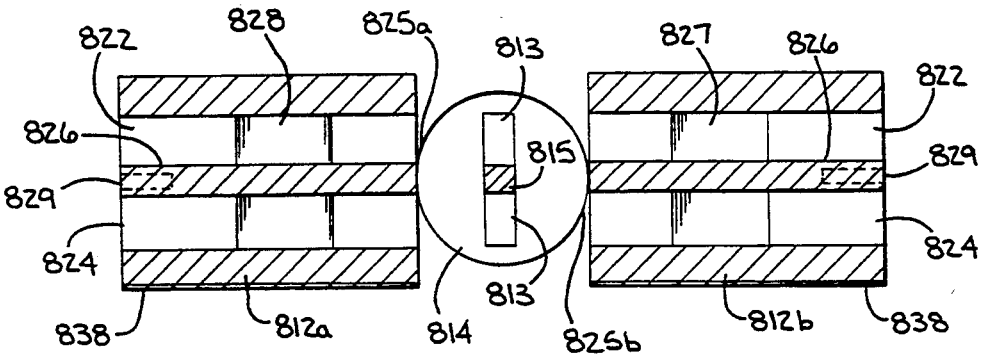
FIG. 6 top cross-sectional view of the connector in FIG. 5.

FIGS. 5 and 6 show still another embodiment of the connector according to the present invention. In this embodiment, the connector 800, similar to the connector 700, includes a socket-engaging portion 810 and an annular hollow outer casing 820 with a structure the same as that of the outer casing 720 of connector 700.

The socket-engaging portion 810 includes an annular wire holding portion 812, a base portion 814, and an annular protrusion 818 protruding from a first end of the base portion 814, thereby forming a shoulder 817 thereat. The annular protrusion 818 has an outer diameter less than that of the base portion 814.

The wire holding portion 812 includes two half casings 812*a* and 812*b* each having two slots 822 and 824 separated by a wall 826 formed therebetween. The half casing 812*a* is integrally formed with a second end of the base portion 814 at an edge 825*a* thereof and the other half casing 812*b* is integrally formed with the second end of the base portion 814 at another edge 825*b* diametrically opposed to the edge 825*a* such that the two half casings 812*a* and 812*b* are respectively pivotable about the edges 825*a* and 825*b*. The base portion 814 is substantially equivalent to the first annular protrusion 714 and the annular protrusion 818 is equivalent to the second protrusion 718. The two half casings 812*a* and 812*b* are substantially equivalent to the two half casings 712*a* and 712*b* except for the axis about which they pivot. All of these elements are of insulating material.

Two guiding channels 813 extend longitudinally of the base portion 814 and the annular protrusions 818 to respectively communicate with the slots 822 and 824 of the half casing 812*a* and 812*b* (when the two half casings 812*a* and 812*b* are closed) and are separated by a wall 815 also extending longitudinally of the base portion 814 and the annular protrusions 818. The annular hollow receiving portion 820 has a compartment 830 with an inner diameter the same as the outer diameter of the assembled casings 812*a* and 812*b* and an opening 832 at one end thereof.

In order to retain the conducting wires 30 and 32 in the wire holding portion 812, a protrusion 828 is formed in slots 822 and 824 of the half casing 812*a*, and a corresponding recess 827 is formed in slots 822 and 824 of the other half casing 812*b*.

Additionally, at least one locking key, e.g. a hook head type 829, is formed on the rear end of the outer periphery of the wire holding portion 812, and at least one receiving hole 819, with or without a protruding retainer, is formed on the rear edge of outer casing 820, such that when the wire holding portion 812 is inserted into the compartment 832 of the outer casing 820, the locking keys 829 engage respectively with the receiving holes 819 to securely retain the wire holding portion 812 in the outer casing 820.

Further, at least one longitudinal straight line ridge 837 is formed on the inside surface of said compartment 830 of said outer casing 820, and at least one longitudinal straight line notch 838 is formed on the outside surface of said wire holding portion 812 at the edge of half casings 812*a* and 812*b*. The longitudinal straight line ridge fits said longitudinal straight line notch to guide said wire holding portion into said outer casing 820 correctly and smoothly until the locking keys 829 are settled and retained in the receiving holes 819.

During assembly, two conducting wires 30 and 32 each with a contact blade 40, are respectively passed through respective guiding channels 813 with the contact blades 40 exposed at the outside of the annular protrusion 818. The two half casings are then closed with the two conducting wires 30 and 32 respectively received in the slots 822 and 824. The two contact blades 40 are bent back around the outside of the annular protrusion 818. Then, the wire holding portions 812 are inserted into the compartment 830 of the outer casing 820 via the opening 832. Accordingly, the assembled connector 800 is ready for engagement with the socket 60.

Figure 7:
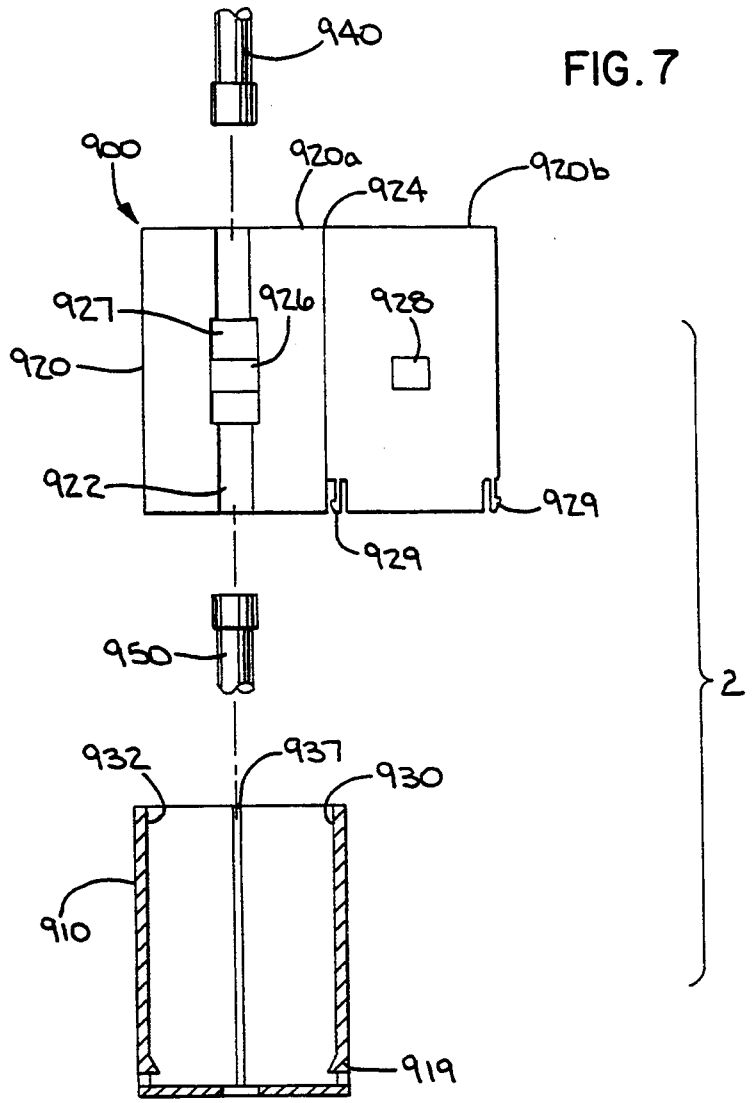
FIG. 7 is an exploded, cross-sectional view of yet another connector in accordance with the present invention.
Figure 8:
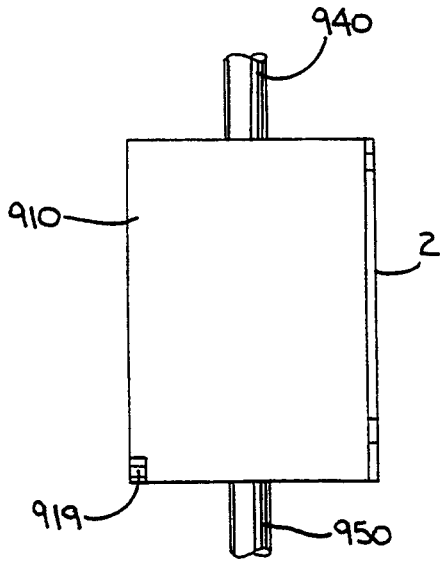
FIG. 8 shows the engagement of the connector in FIG. 7 with conducting wires.

FIG. 7 and 8 show yet another embodiment of the connector according to the present invention. In this embodiment, the connector 2 suitable for use in connecting two wires respectively for two Christmas light strings, includes a wire holding portion 920 and an outer casing 910. The wire holding portion 920 is integrally formed and includes two half casings 920*a* and 920*b*. The half casing 920*a* has one slot 922 along the central axis of the half casing 920*a*. The slot 922 has a wide section 927 and deep section 926 in the middle portion thereof. The half casing 920*b* has a square protrusion 928 corresponding to the deep section 926 of the half casing 920*a*.

Additionally, at least one locking key, e.g. a hook head type 929, is formed at the front end of the outer periphery of the wire holding portion 920, and at least one receiving hole 919, with or without a protruding retainer, is formed on the front end of the outer casing 910, such that when the wire holding portion 920 is inserted into the compartment 932 of the outer casing 910, the locking keys 929 engage respectively with the receiving holes 919 to securely retain the wire holding portion 920 in the outer casing 910.

Further, at least one longitudinal straight ridge 937 is formed on the inside surface of said compartment 930 of said outer casing 910, and at least one longitudinal straight notch 738 (not shown) is formed on the outside surface of said wire holding portion 920. The longitudinal straight ridge fits said longitudinal straight notch to guide said wire holding portion into said outer casing 910 correctly and smoothly until the locking keys 929 are settled and retained in the receiving holes 919.

During assembly, two conducting wires 940 and 950, each with contact blades 40 settled together or connected by other suitable means, are connected into the slot 922 of the half casings 920*a* with the contacted blades placed in the wide section 926. The two half casings 920*a*, 920*b* are then closed and inserted into the compartment 930 of the outer casing 910 via the opening 932. Accordingly, the assembly connector 2 is completed to a status show in FIG. 8.

The locking keys and receiving holes disclosed in the aforementioned embodiments can be located respectively at the appropriate position on the outer surface of said wire holding portion and on the outer casings or receiving portions.

Figure 9:
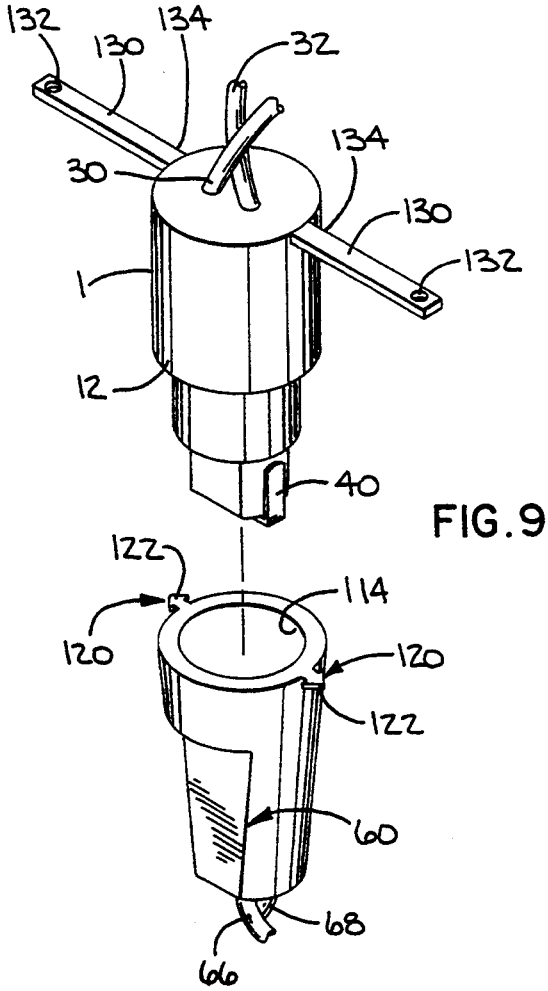
FIG. 9 is a perspective view showing a fastener for the engagement between the connector according to the present invention and a conventional socket.
Figure 9A:
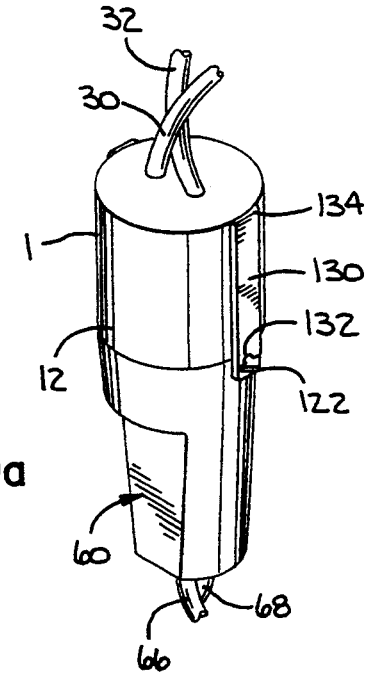
FIG. 9*a* shows the engagement of the connector and the socket of FIG. 9.

Referring to FIGS. 9 and 9*a*, aforesaid connector 1 and socket 60 are shown in a preferred form with fastener means in according with this invention. The fastener means includes at least one snapping element 120 and at least one flat tongue 130. The snapping element 120 is substantially flat and has an outer bead-shaped head portion 122 and a neck portion which is integral with the socket 60. The flat tongue 130 is substantially flat and has a hole 132 shaped in an ellipse, square, or other shape suitable for fastening at the free end thereof and a flexible thinner portion 134 which is integrally formed with the upper periphery of the connector 1. Also, both the snapping heads and the flat tongues are made of resilient material such as plastic.

The hole 132 receives the bead-shaped head 122 by bending the flat tongue 130 downward about the thinner portion 134 so that the snapping element 120 with the bead-shaped head portion 122 is forced through the hole 132 of the flat tongue 130 to create a snap connection. Accordingly, the snapping element 120 snaps into the hole 132. Alternatively, the snapping element 120 can be formed in the vicinity of the upper margin of connector 1, and the flat tongue 130 can be formed on the upper margin of the periphery of the socket 60 with the same securing function. Also the flat tongue can be formed on the lower periphery of wire holding section 12 and be shorter in length.

In addition, when the connector 1 and the socket 60 are in position as shown in FIG. 9, the distance between an upper surface of the connector 1 and a lower surface of the snapping element 120 on the socket 60 is approximately the same as the length of the distance between the hole 132 and the thinner portion 134 closed to the connector 1. Therefore, the connector 1 and the socket 60 are securely fastened together.

To replace the connector 1, the above procedure is simply duplicated in reverse order: the flat tongue 130 is removed by urging one side past the bead-shaped head portion of the snapping element 120.

For a more secure fastening arrangement, a second snapping element 120 and a second flat tongue 130 may be diametrically disposed on the connector 1 and socket 60, respectively as shown in FIG. 9.

Figure 10:
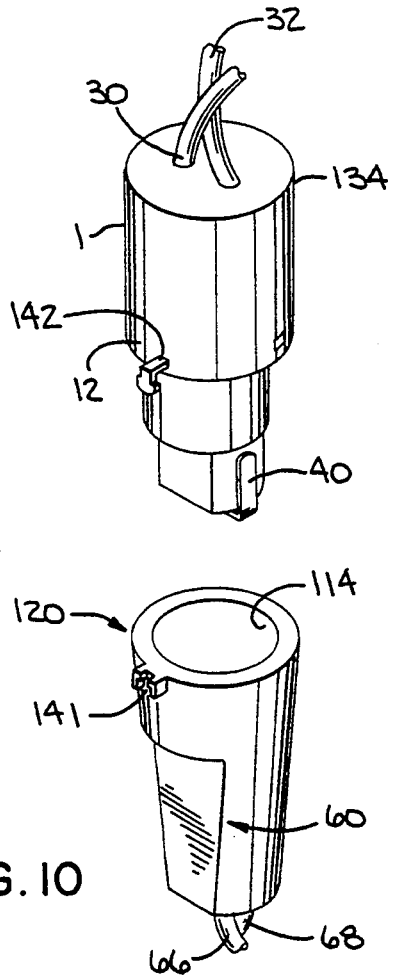
FIG. 10 is a perspective view showing another fastener for engagement between the connector, according to the present invention, and a conventional socket.
Figure 10A:
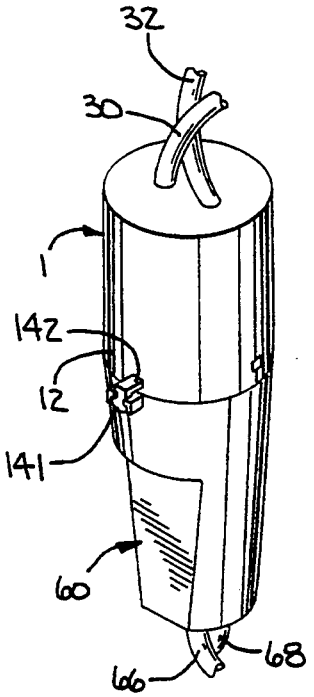
FIG. 10*a* shows the engagement of the connector and the socket of FIG. 10.

FIGS. 10 and 10*a* show another embodiment of fastener means for connector and socket in accordance with the present invention. As in the previous embodiment, the connector 1 and socket 60 have a fastening means disposed thereon. The fastening means comprises two sets of snapping brackets 141 and a retention bar 142. One set of snapping brackets 141 is integrally disposed on the upper periphery of the connector 1 and one set of snapping brackets is correspondingly and integrally disposed on an upper periphery of the socket 60. The snapping brackets 142 are substantially flat and L-shaped with the bases of the L's opposing and pointing toward each other. The retention bar 142 is substantially flat and has a bead-shaped head.

The fastening procedure is as in the previous embodiment. The connector 1 is inserted into the socket 60 with the sets of snapping brackets 141 aligned. The retention bar 142 is then urged past a slot between the bases of the L's of the snapping brackets 141, thereby snapping into place. The width of the vertical portion of the retention bar 142 is slightly greater than the width of the slot between the bases of the L's on the snapping bracket. Accordingly, the connector 1 and the socket 60 are securely fastened together as shown in FIG. 10*a*. As before, for removal this procedure is simply repeated in reverse order.

Figure 11:
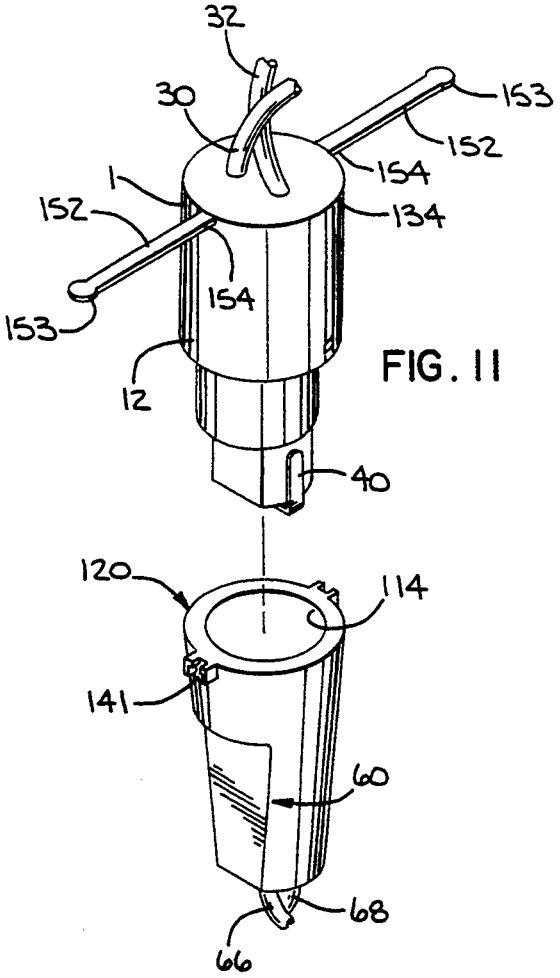
FIG. 11 is a perspective view showing yet another fastener for the engagement between a connector, according to the present invention, and a conventional socket.
Figure 11A:
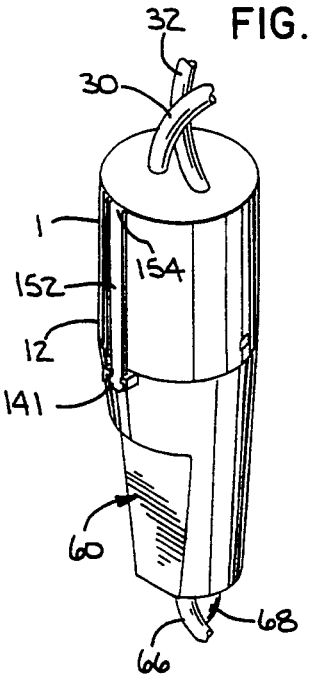
FIG. 11*a* shows the engagement of the connector and the socket of FIG. 11.

FIGS. 11 and 11*a* show yet another embodiment of fastener means for connector and socket in according with this invention. The fastener means includes at least one snapping bracket 141 and at least one flat tongue 152. The snapping bracket 141 is substantially the same as snapping bracket 141 in the previous embodiment for the socket 60. The flat tongue 152 is substantially flat and has a bead-shaped head 153 toward a free end thereof and a flexible thinner portion 152, which is integral with the upper periphery of the connector 1. Also both the snapping heads and the flat tongues are made of resilient material such as plastic.

The bead-shaped head 153 is snappable with the snapping bracket 141 by bending the flat tongue 152 downward about the flexible portion 154 such that the bead-shaped head 153 is forced into the space between the L-shaped snapping bracket 141. Accordingly, the bead-shaped head 153 snaps into the snapping bracket 141. Alternatively, the snapping bracket 141 can be formed in the vicinity of the upper margin of connector 1, and the flat tongue 152 can be formed on the upper margin of the periphery of the socket 60 with the same securing function. Also the flat tongue 152 can be formed on the lower periphery of wire holding section 12 and be shorter in length.

In addition, when the connector and the socket 60 are in position as shown in FIG. 11*a*, the distance between an upper surface of the connector 1 and a lower surface of the snapping bracket 141 on the socket 60 is approximately the same as the length of the distance between the bead-shaped head 153 and the thinner portion 154 closed to the connector 1. Therefore, the connector 1 and the socket 60 are securely fastened together.

To replace the connector 1, the above procedure is simply duplicated in reverse order: the flat tongue 152 is removed by urging the bead-shaped head 153 out of the snapping bracket 141.

For a more secure fastening arrangement, a second snapping bracket and a second flat tongue 141 153 may be diametrically disposed on the connector 1 and socket 60 respectively as shown in FIG. 11; and fasteners, locking keys, and receiving holes applied to connector 1 are also applicable to connectors 700, 800, and 2.

Figure 12:
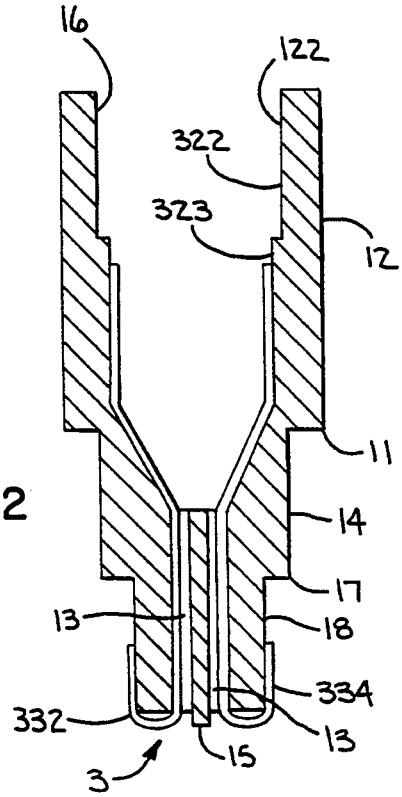
FIG. 12 is cross-sectional view of yet another connector in accordance with the present invention.

Referring to FIG. 12 another connector 3 is shown in a preferred form, according to the present invention. In this embodiment, the connector 3 includes a first annular protrusion 14 and a second annular protrusion 18. The annular hollow receiving portion 12 has a compartment 122 therein and an opening 16 at one end thereof. A first end of the first annular protrusion 14 protrudes from the other end of the receiving portion 12, thereby forming a first shoulder 11 thereat. A first end of the second annular protrusion 18 protrudes from a second end of the first annular protrusion 14, thereby forming a second shoulder 17 thereat. The receiving portion 12, the first annular protrusion 14, and the second protrusion 18 are integrally made of insulating material.

The first annular protrusion 14 has an outer diameter less than an inner diameter of the annular hollow receiving portion 12. The second annular protrusion 18 has an outer diameter less than the outer diameter of the first annular protrusion 14. Two guiding channels 13 extend longitudinally of the first and second annular protrusions 14 and 18 to communicate with the compartment 122 of the receiving portion 12 and are separated by a wall 15, also extending longitudinally in the first and second annular protrusions 14 and 18. The compartment 122 is divided into first compartment 322 and second compartment 323. The diameter of first compartment 322 is a little larger than the first annular protrusion 14 and the diameter of second compartment 323 is also a little larger than the second annular protrusion 18. The first compartment 322 and the second compartment 323 are both formed as a cylinder and have a length equivalent respectively to the length of the first annular protrusion 14 and the second annular protrusion 18. At the bottom of second compartment 323 a conical space is formed. Of course, this connector is made of insulating plastic. Two metal conductors formed like flat wires 332 334 are faced to each other and bonded on the inside surface of second compartment 323 in one end and extend through the slots 13 and are bent back around the outside of the connector 3 for engagement with the socket 60. The socket receives the aforesaid connector 1, or a lamp bulb, or a gadget such as a small motor, an IC flasher, an IC music chip, etc., or another connector 3. The gadget inserted in the connector 3 should have substantially the same impedance as a lamp bulb.

Figure 12A:
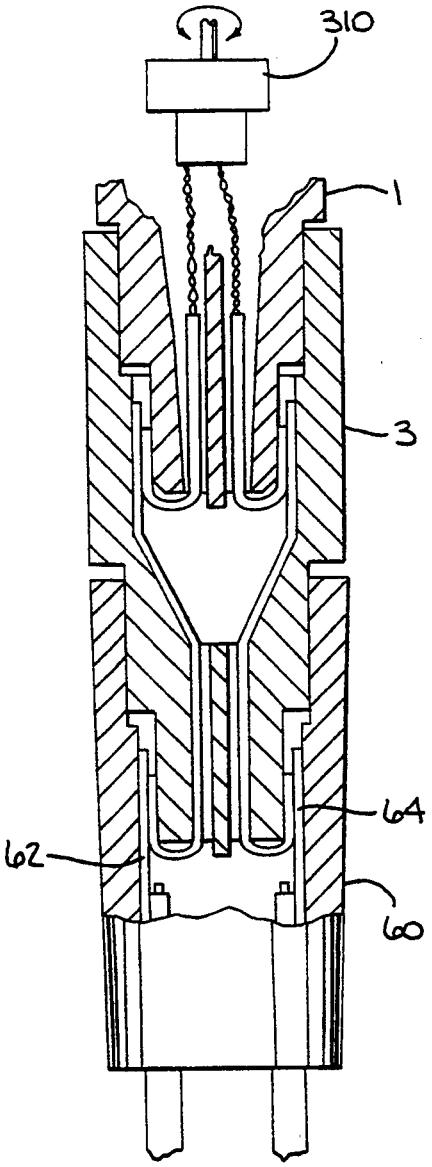
FIGS. 12*a* and 12*b* are cross-sectional views showing a small motor and a lamp bulb respectively held in the receiving portion of the connector of FIG. 12.

FIG. 12*a* shows another embodiment of the connector 3 according to the present invention, in which the connector 3 is put into socket 60 and a small motor, connected with the connector 1, is inserted into the connector 3.

Figure 12B:
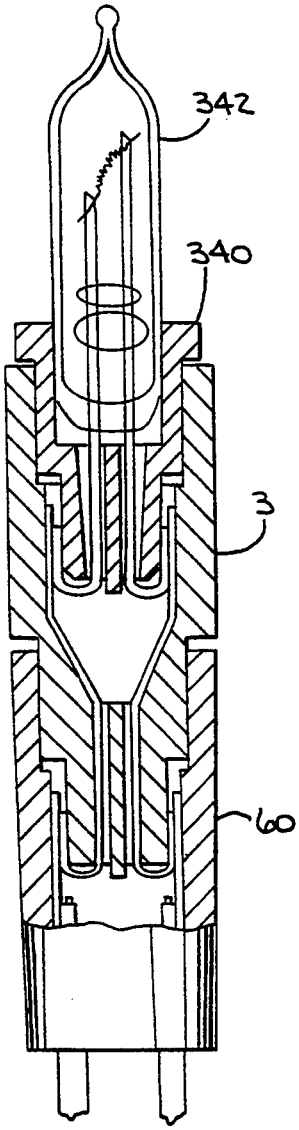

FIG. 12*b* shows another embodiment of the connector 3 according to the present invention. It is like the previous embodiment but instead of a small motor, a lamp bulb 342 is connected to the connector 3 with a conventional lamp base 340.

Figure 13:
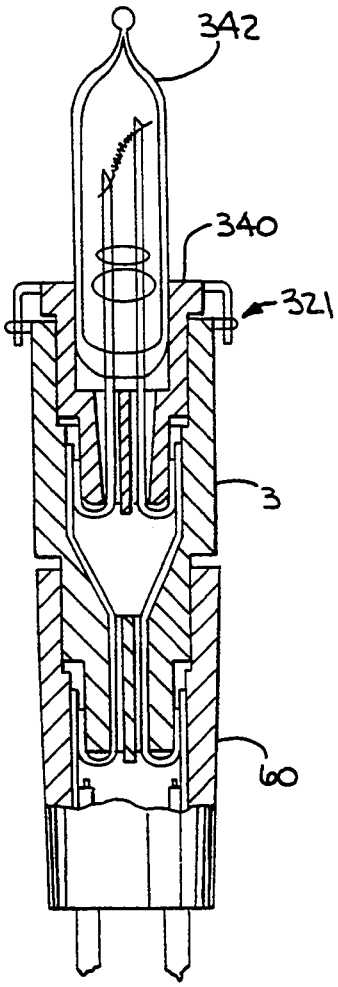
FIG. 13 is sectional view showing a set of fastener means formed on the connector of FIG. 12.

FIG. 13 shows another embodiment of the connector 3, according to the present invention. It is like the previous embodiment except that between lamp base and connector 3 a fastener is fixed. This fastener is made according to the present invention and comprises two parts which are respectively formed integrally with the lamp base 340 and connector 3.

Figure 14:
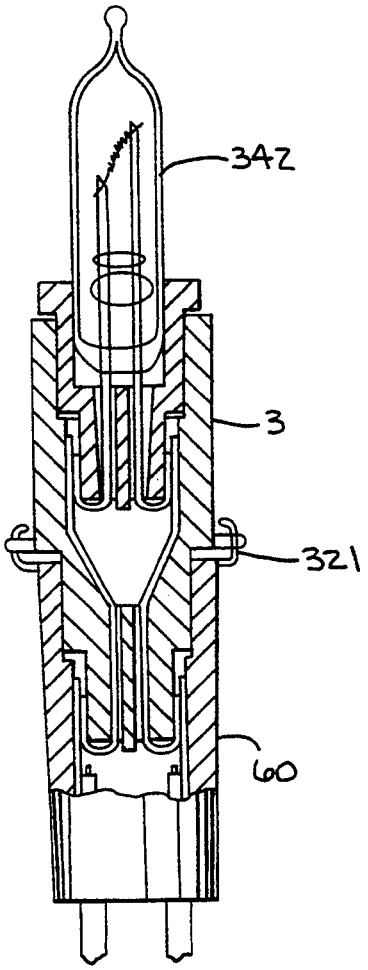
FIG. 14 cross-sectional view showing yet another set of fasteners formed on the connector of FIG. 12.

FIG. 14 shows another embodiment of the connector 3 according to the present invention. It is like the previous embodiment except that the fastener 321 is formed between the connector 3 and the socket 60.

Figure 15:
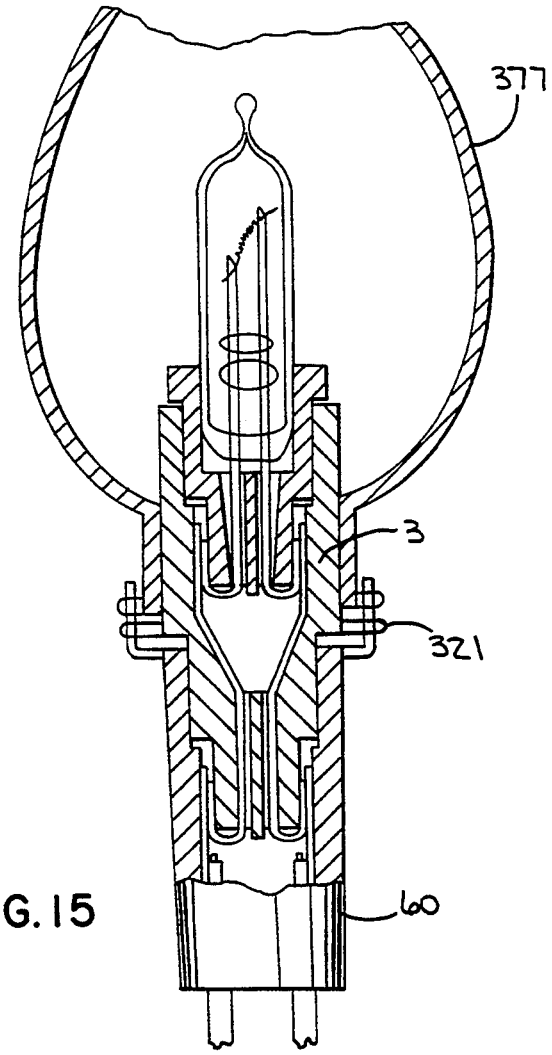
FIG. 15 is a cross-sectional view showing yet another connector of FIG. 12 engaged between the socket and an ornament.
Figure 16:
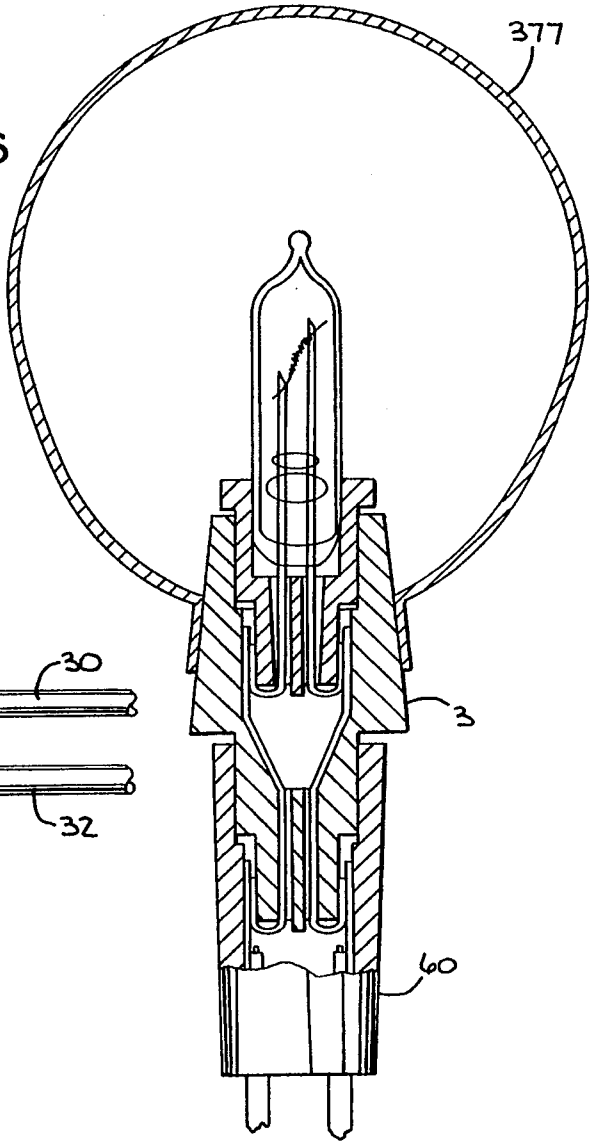
FIG. 16 is a cross-sectional view showing yet another connector of FIG. 12 engaged between the socket and an ornament.
Figure 17:
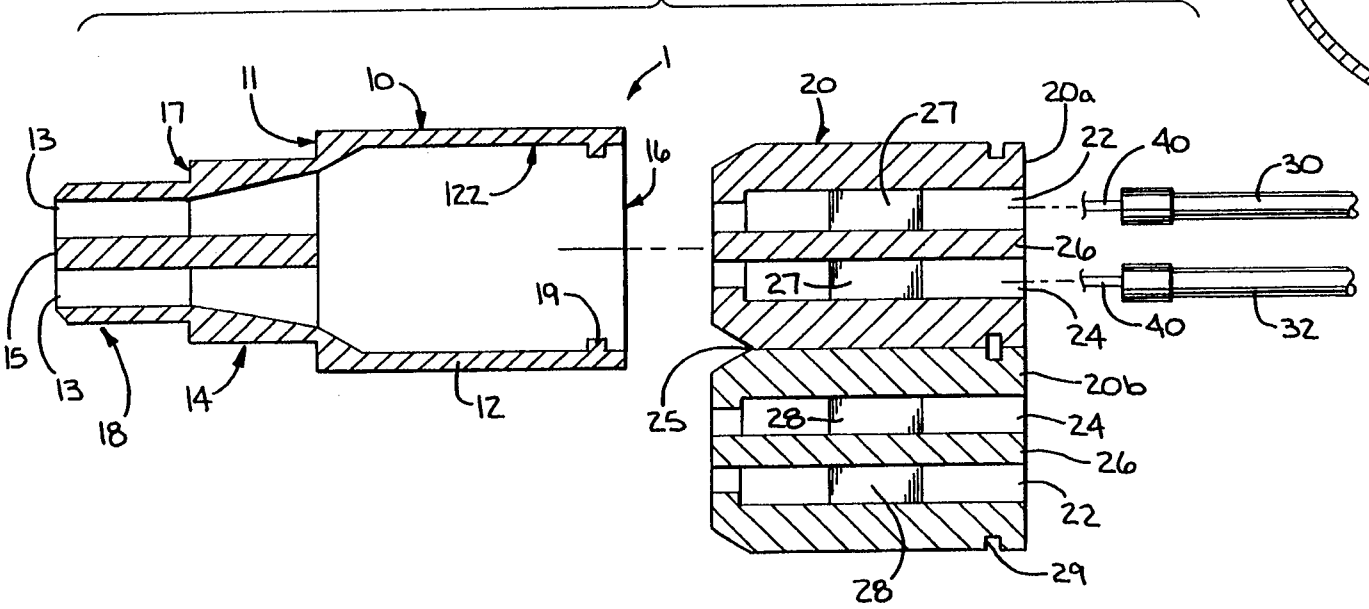
FIG. 17 (PRIOR ART)
FIG. 17 is an exploded, cross-sectional view of a conventional connector.
Figure 18:
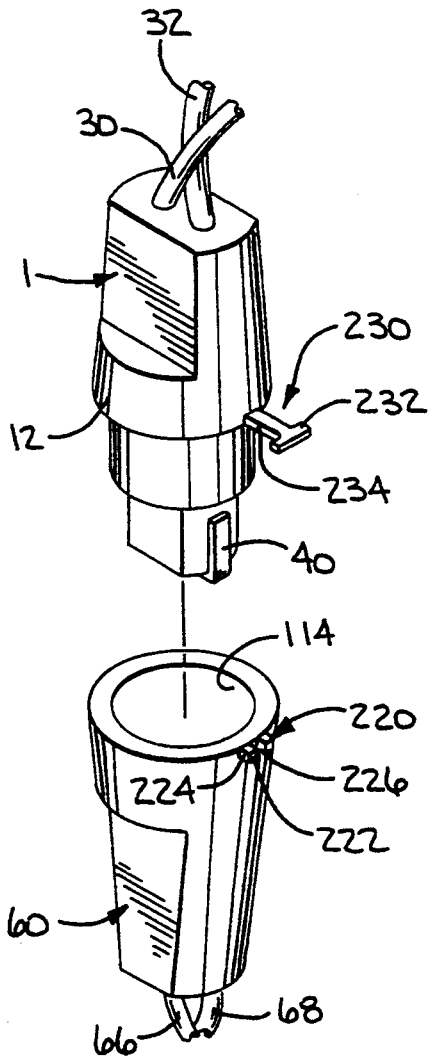
FIG. 18 (PRIOR ART)
FIGS. 18 and 18*a* are perspective views showing a conventional fastener set between a connector and a socket of the prior art.
Figure 18A:
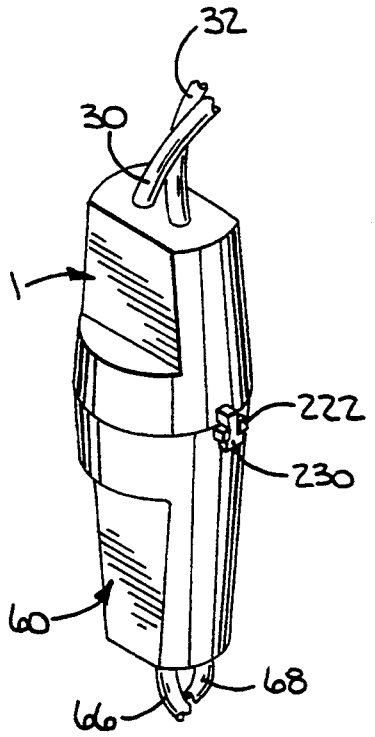
FIG. 18a (PRIOR ART)

FIG. 15 shows another embodiment of the connector 3 according to the present invention. It is like the previous embodiment except that an ornament 377, one of various shaped lamp covers, is attached to the connector 3. This ornament is also fixed by a fastener with the connector 3 and socket 60 at the same place, FIG. 16 shows another embodiment of the connector 3 according to the present invention. It is like the previous embodiment except that the ornament 377 is not fixed by a fastener to the connector 3 and socket 60. The periphery of the connector 3 is formed as a cone. Its bottom diameter is larger than the upper diameter so that when an ornament is put on the connector with appropriate force, the ornament will be securely positioned thereon and held by friction.

While the present invention has been explained in relation to its preferred embodiment, it is to be understood that various modifications thereof will be apparent to those skilled in the art upon reading this specification. Therefore, it is to be understood that the invention disclosed herein is intended to cover all such modifications as fall within the scope of the appended claims.

We claim:

1. A connector for electrically connecting a light string to a socket (60) of another light string, the socket (60) having two contacts (62 64) which are respectively electrically connected with one or two conducting wires (66 68) of the another light string, each of the two contacts (62 64) being electrically connected to a contact blade (40) of the connector (1), the contact blades (40) each having a distal end and being respectively attached to one of two conducting wires (30 32) which are secured in said connector (1), said connector comprising:

a wire holding portion (20) for receiving and holding the two conducting wires (30 32) and including two half casings (20*a* 20*b*) each having two wire slots (22 24) separated by a wall (26) formed therebetween, said two half casings (20*a* 20*b*) being formed together at one edge (25) thereof so that said two half casings (20*a* 20*b*) are pivotable with respect to each other; and a socket-engaging portion (10) for engaging with the said socket (60) and including an annular hollow receiving portion (12), a first annular protrusion (14), a second annular protrusion (18) and two slots (13) extending longitudinally of said first and second annular protrusions (14 18) and separated by a wall (15) to communicate with a compartment (122) of said receiving portion (12), each said slot (13) receiving one of said two contact blades (40) whose distal ends are bent back around an outside of said second annular protrusion (18) i.e. for engagement with the contacts (62 64) of said socket (60);

wherein locking keys (129) are formed on a front end of said wire holding portion (20), and receiving holes (119) are formed on said receiving portion (12) close to the first annular protrusion (14) for engagement with said locking keys (129) when said wire holding portion (20) is inserted into said compartment (122), for securely retaining said wire holding portion (20) in said socket-engaging portion (10), said connector further comprising at least one longitudinal straight ridge (127) formed on an inside surface of said compartment (122) of said receiving portion (12) and at least one corresponding longitudinal straight notch (128) is formed on an outside surface (132) of said wire holding portion (20), said longitudinal straight ridge (127) fitting said longitudinal straight notch (128) together to guide said wire holding portion (20) into said receiving portion (12) correctly and smoothly.

2. A connector for electrically connecting a light string to a socket (60) of another light string, the socket (60) having two contacts (62 64) which are respectively electrically connected with one or two conducting wires (66 68) of the another light string, each of the two contacts (62 64) being electrically contact blade (40 ) of the connector (1), the contact blades (40) each having a distal end and being respectively attached to one of two conducting wires (30 32) which are secured in said connector (1), said connector comprising:

a wire holding portion (20) for receiving and holding the two conducting wires (30 32) and including two half cagings (20*a* 20*b*) each having two wire slots (22 24) separated by a wall (26) formed therebetween, said two half casings (20*a* 20*b*) being formed together at one edge (25) thereof so that said two half casings (20*a* 20*b*) are pivotable with respect to each other; and a socket-engaging portion (10) for engaging with the said socket (60) and including an annular hollow receiving portion (12), a first annular protrusion (14), a second annular protrusion (18) and two slots (13) extending longitudinally of said first and second annular protrusions (14 18) and separated by a wall (15) to communicate with a compartment (122) of said receiving portion (12), each said slot (13) receiving one of said two contact blades (40) whose distal ends are bent back around an outside of said second annular protrusion (18) i.e. for engagement with the contacts (62 64) of said socket (60);

wherein locking keys (129) are formed on a front end of said wire holding portion (20), and receiving holes (119) are formed on said receiving portion (12) close to the first annular protrustion (14) for engagement with said locking keys (129) when said wire holding portion (20) is inserted into said compartment (122), for securely retaining said wire holding portion (20) in said socket-engaging portion (10), wherein said locking keys are two locking keys (129) each with a hook like head formed opposite to each other diagonally and closing to the wire slots (22, 24) at the front end of said wire holding portion (20), and said corresponding receiving holes (119) are two receiving holes formed opposite to each other diagonally, each closed to the slot (13) and on the receiving portion (12) of said socket-engaging portion (10), wherein a protruding square retainer is on a lower side of the receiving holes (119).

3. A connector as claimed in claim 1, wherein said longitudinal straight ridges (127) are formed opposite to each other and along the direction of wall (15) inside said compartment (122) of said receiving portion (12), and said longitudinal straight notches (128) are formed opposite to each other and along the direction of wall (26) on said wire holding portion (20).

4. A connector as claimed in claim 1, further comprising:

at least one flexible flat tongue (130) formed on an outer periphery of the receiving portion (12) of said connector and snapped fit with a corresponding snapping element (12) on an outer periphery of a socket (60) when said connector is engaged with said socket (60).

5. A connector as claimed in claim 4, wherein said flat tongue (13) is formed on a lower edge of the periphery of the receiving portion (12) of said connector.

6. A connector as claimed in claim 4, wherein said flat tongue (130) is a flexible band with ellipse hole on a free end and a thinner portion at another end of the flat tongue.

7. A connector as claimed in claim 6, wherein said hole is in a form of a square hole.

8. A connector as claimed in claim 4, wherein said flat tongue (130) has a retention bar (42) having a bead shaped head on a free end integrally formed at another end of the connector and snapped into a pair of L-shaped snapping bracket (141) on the periphery of a socket.

9. A socket means for electrically connecting a connector as claimed in claim 1.

* * * * *